US009053686B2

(12) United States Patent
Ikeda et al.

(10) Patent No.: US 9,053,686 B2
(45) Date of Patent: Jun. 9, 2015

(54) MUSIC BOX

(71) Applicants: Akihiro Ikeda, Obu (JP); Yasuhiro Shibata, Okazaki (JP)

(72) Inventors: Akihiro Ikeda, Obu (JP); Yasuhiro Shibata, Okazaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/153,413

(22) Filed: Jan. 13, 2014

(65) Prior Publication Data

US 2014/0202304 A1 Jul. 24, 2014

(30) Foreign Application Priority Data

Jan. 22, 2013 (JP) ..... 2013-009371

(51) Int. Cl.

| | |
|---|---|
| ***G10F 1/06*** | (2006.01) |
| ***G10F 5/06*** | (2006.01) |
| ***G04B 23/00*** | (2006.01) |

(52) U.S. Cl.

CPC ..... *G10F 1/06* (2013.01); *G04B 23/005* (2013.01); *G04B 23/00* (2013.01); *G10F 5/06* (2013.01)

(58) Field of Classification Search

CPC ..... G10F 1/06; G10F 5/06; G04B 23/00; G04B 23/005

USPC ..... 84/97, 98, 94.1, 95.1

See application file for complete search history.

(56) References Cited

U.S. PATENT DOCUMENTS

| | | | | | |
|---|---|---|---|---|---|
| 593,762 | A | * | 11/1897 | Brachhausen | 84/98 |
| 2,557,061 | A | * | 6/1951 | Goldman | 84/94.1 |
| 2,961,911 | A | * | 11/1960 | Duncan | 84/97 |
| 3,148,576 | A | * | 9/1964 | Kunz | 84/95.1 |
| 3,225,640 | A | * | 12/1965 | Kunz | 84/95.1 |
| 3,342,499 | A | * | 9/1967 | Niimi et al. | 369/186 |
| 4,466,328 | A | * | 8/1984 | Kitamura | 84/98 |
| 4,676,135 | A | * | 6/1987 | Kitazawa et al. | 84/94.1 |
| 4,890,528 | A | * | 1/1990 | Kamijima | 84/95.2 |
| 5,498,833 | A | * | 3/1996 | Huang | 84/94.1 |
| 5,955,687 | A | * | 9/1999 | Miyagi et al. | 84/97 |
| 5,973,240 | A | * | 10/1999 | Isaka | 84/97 |

(Continued)

FOREIGN PATENT DOCUMENTS

| | | | | | |
|---|---|---|---|---|---|
| JP | 11272267 | A | * | 10/1999 | G10F 1/06 |
| JP | 11272268 | A | * | 10/1999 | G10F 1/06 |

(Continued)

OTHER PUBLICATIONS

Japanese Official Action dated Dec. 2, 2014 received in related application JP 2013-009371 together with an English language translation.

*Primary Examiner* — David Warren
*Assistant Examiner* — Christina Schreiber
(74) *Attorney, Agent, or Firm* — Scully, Scott, Murphy & Presser, P.C.

(57) ABSTRACT

A music box includes a plurality of star wheels, a frame, a casing, a vibration plate, and a moving mechanism. Each of the plurality of star wheels being configured to rotate about a first axis. The frame is configured to rotatably support the first axis. The vibration plate comprises a plurality of vibration valves corresponding to the plurality of star wheels. Each of the plurality of vibration valves is extending in a first direction. The plurality of vibration valves is arrayed along a second direction parallel to the first axis. The vibration plate is fixed to the casing. The moving mechanism is configured to move the frame to the vibration plate in the first direction.

6 Claims, 8 Drawing Sheets

(56) References Cited

U.S. PATENT DOCUMENTS

| | | | | |
|---|---|---|---|---|
| 6,013,867 | A * | 1/2000 | Isaka | 84/97 |
| 6,300,548 | B1 * | 10/2001 | Zhu et al. | 84/94.1 |
| 7,250,565 | B2 * | 7/2007 | Hermanson et al. | 84/94.1 |
| 7,544,870 | B2 * | 6/2009 | White | 84/94.1 |
| 2004/0031370 | A1 * | 2/2004 | Ueno et al. | 84/94.1 |
| 2004/0065184 | A1 * | 4/2004 | Isaka et al. | 84/94.1 |
| 2004/0123718 | A1 * | 7/2004 | Muramatsu et al. | 84/94.1 |
| 2006/0169122 | A1 * | 8/2006 | Meng-Suen | 84/94.1 |
| 2008/0184863 | A1 * | 8/2008 | White | 84/95.1 |
| 2012/0192697 | A1 * | 8/2012 | Favre | 84/95.1 |
| 2014/0202302 | A1 * | 7/2014 | Ikeda | 84/95.1 |
| 2014/0202303 | A1 * | 7/2014 | Ikeda | 84/98 |
| 2014/0202304 | A1 * | 7/2014 | Ikeda et al. | 84/98 |

FOREIGN PATENT DOCUMENTS

| | | | |
|---|---|---|---|
| JP | 2001-175251 | A | 6/2001 |
| JP | 2009116323 | A * | 5/2009 |
| JP | 2011128348 | A * | 6/2011 |
| JP | 2004-294495 | A | 10/2014 |

* cited by examiner

MUSIC BOX

CROSS REFERENCE TO RELATED APPLICATION

This application claims priority from Japanese Patent Application No. 2013009371 filed Jan. 22, 2013. The entire content of this priority application is incorporated herein by reference.

TECHNICAL FIELD

The present disclosure relates to a music box, and particularly to a music box that suppresses the production of unwanted noise.

BACKGROUND

Music boxes for playing melodies are disclosed. One such music box includes: a plurality of star wheels rotatably supported on a first shaft and having a plurality of protruding parts that protrude radially outward; a vibration plate disposed along the first shaft that has a plurality of vibration valves corresponding to the plurality of star wheels; and a solenoid corresponding to each star wheel. The solenoid is driven to control the rotation of the corresponding star wheel. By controlling the rotation of the star wheels with the solenoids, the protruding parts can be selectively made to contact and pluck the corresponding vibration valves at a prescribed timing. Accordingly, the conventional music box device can play arbitrary musical pieces, without having to replace a rotating member, such as a cylinder or disc.

SUMMARY

For regulating the volume of a sound-producing device, such as a music box, a sound-producing device has a vibration plate provided with sound-producing bodies, and another plate provided with protruding parts in positions corresponding to the sound-producing bodies. The plate on which the protruding parts are provided can be moved to vary the positional relationships of the protruding parts relative to the sound-producing bodies in order to perform fine volume adjustments in the sound-producing device.

Precision is necessary for adjusting the volume of the music box. In the conventional technology described above, the protruding parts provided on opposing ends of the vibration plate may not move parallel to each other. Consequently, the distance between these protruding parts on opposing ends and the vibration plate may vary. This difference in distance can cause sound-producing bodies on opposing ends of the vibration plate to produce sounds at different volumes. Accordingly, the conventional sound-producing device cannot properly adjust sound volume. In view of the foregoing, it is an object of the present disclosure to provide a music box capable of suitably adjusting sound volume.

In order to attain the above and other objects, the disclosure provides a music box. A music box includes a plurality of star wheels, a frame, a casing, a vibration plate, and a moving mechanism. Each of the plurality of star wheels being configured to rotate about a first axis. The frame is configured to rotatably support the first axis. The vibration plate comprises a plurality of vibration valves corresponding to the plurality of star wheels. Each of the plurality of vibration valves is extending in a first direction. The plurality of vibration valves is arrayed along a second direction parallel to the first axis.

The vibration plate is fixed to the casing. The moving mechanism is configured to move the frame to the vibration plate in the first direction.

BRIEF DESCRIPTION OF THE DRAWINGS

For a more complete understanding of the present disclosure, and the objects, features, and advantages thereof, reference now is made to the following descriptions taken in connection with the accompanying drawings.

DETAILED DESCRIPTION

Next, a music box 10 according to a preferred embodiment of the present disclosure will be described while referring to the accompanying drawings.

Figure 1:
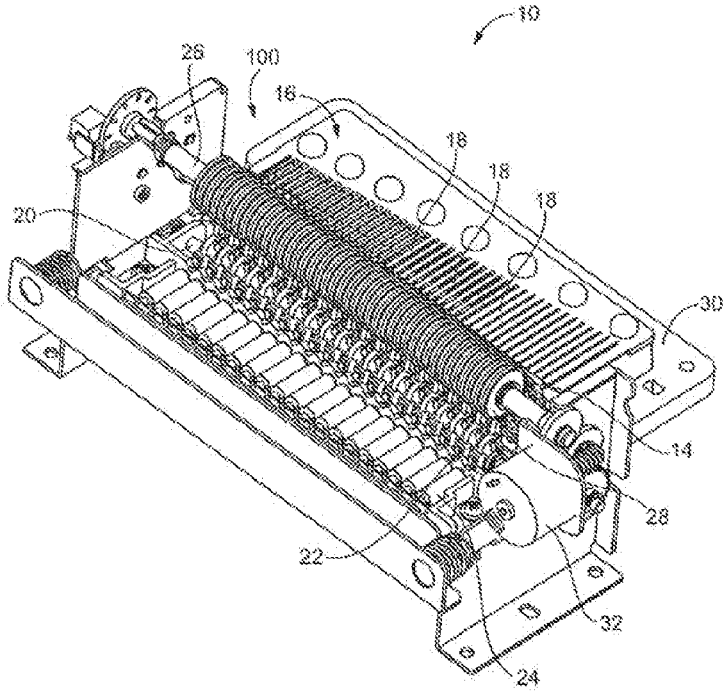
FIG. 1 is a schematic perspective view of a music box according to one or more aspects of disclosure.

FIG. 1 shows the structure of a mechanical performance unit 100 provided in the music box 10 according to the preferred embodiment. FIG. 1 is a perspective view of the mechanical performance unit 100 from obliquely above the same. In the preferred embodiment, the top of the music box 10 will be considered the uppermost portion of the music box 10 in a general vertical direction when the music box 10 is resting on a flat surface (not shown).

As shown in FIG. 1, the mechanical performance unit 100 includes a first shaft 12 (see FIG. 2 and other drawings); a plurality (forty in this example) of star wheels 14 rotatably provided on the first shaft 12 (example of first axis); a vibration plate 16 provided alongside the first shaft 12 and each having a plurality of vibration valves 18 juxtaposed along the first shaft 12 in one-to-one correspondence with the star wheels 14; a pair of third shafts 20 arranged along the first shaft 12, and preferably parallel to the first shaft 12; a plurality of anchoring members 22 pivotally movable about each of the third shafts 20 and provided in one-to-one correspondence with each of the star wheels 14; a plurality of electromagnets 24 disposed in one-to-one correspondence with the anchoring members 22; a second shaft 26 arranged parallel to the first shaft 12; a plurality of sun wheels 28 provided on the second shaft 26 in one-to-one correspondence with the star wheels 14 so as to rotate together with and not relative to the second shaft 26; a bedplate 29 serving as a mounting base for the vibration plate 16; a frame-moving device 80 adapted to move a frame 30*b* described later; and a motor 32 adapted to produce a drive force for driving the first shaft 12 and the second shaft 26 to rotate about their axes in synchronization. As will be described later, the bedplate 29 and the frame 30*b* are capable of moving relative to each other. The vibration valves 18 correspond to discrete predetermined musical tones and produce a sound at the corresponding tone when plucked by a protruding part 36 (described later) on the corresponding star wheel 14. The mechanical performance unit 100 shown in FIG. 1 is accommodated in an enclosure 34 of the music box 10 described below by assembling the bedplate 29 to the enclosure 34. The enclosure 34 serves as a casing.

The sun wheels 28 are fixed to the second shaft 26. Preferably, the sun wheels 28 are fixed to the second shaft 26 in a state where each sun wheel that is movable in the axial direction of the second shaft 26 and unrotatable relative to the second shaft 26 is interposed between the pair of neighboring sun wheels 28, thereby fixing the sun wheels to the second shaft 26. Alternatively, the sun wheels 28 may be already fixed to the second shaft 26 so as to be incapable of moving axially or rotating relative to the same before the star wheels 14 are interposed therebetween.

Figure 10:
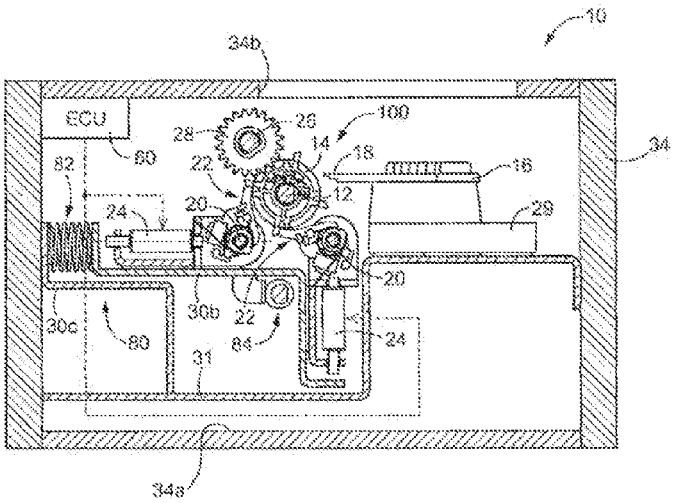
FIG. 10 is a cross-sectional view of the music box when the mechanical performance unit is accommodated in an enclosure according to one or more aspects of the disclosure FIG. 11 a block diagram of control functions of an electric control unit in the music box.

FIG. 10 is an explanatory diagram showing the music box 10 of the preferred embodiment when the mechanical performance unit 100 of FIG. 1 is accommodated inside the enclosure 34. As shown in FIG. 10, the music box 10 is provided with the enclosure 34 for accommodating therein the components of the mechanical performance unit 100, including the first shaft 12, the star wheels 14, the vibration plate 16, the third shafts 20, the anchoring members 22, the electromagnets 24, the second shaft 26, and the sun wheels 28. The enclosure 34 includes a lower frame 31 at the lower portion thereof, the frame 30*b*, and a frame 30*c* fixedly provided on the lower frame 31. The frame 30*b* rotatably supports the first shaft 12 and the second shaft 26 about their center axes, non-rotatably supports the third shaft 20, and serves as a mounting base for the electromagnets 24 and the like. The mechanical performance unit 100 having the structure shown in FIG. 1 is accommodated inside the enclosure 34 by mounting the bedplate 29 on the enclosure 34 and mounting the frame 30*b* on the lower frame 31. As shown in FIG. 10, the enclosure 34 defines an inner bottom surface 34*a*, and a viewing window 34*b*.

As indicated by a chain line in FIG. 10, the center of the third shaft 20 and at least some of the electromagnets 24 are arranged in the same plane, which is parallel to the inner bottom surface 34*a* of the enclosure 34. That is, some of the electromagnets 24 extending in horizontal direction are arranged in the plane indicated by the chain line, and remaining of the electromagnets 24 extending in vertical direction are shifted from the plane. Note that all of the electromagnets 24 may be arranged parallel to the inner bottom surface 34*a* of the enclosure 34.

The viewing window 34*b* is provided in the flat upper wall constituting the enclosure 34 to reveal the components inside the enclosure 34. The viewing window 34*b* is provided with a cover part (not shown) formed of glass or another transparent material. As shown in FIG. 10, the music box 10 also includes an electric control unit (ECU) 60 adapted to control the excitation and non-excitation of each electromagnet 24.

Figure 2:
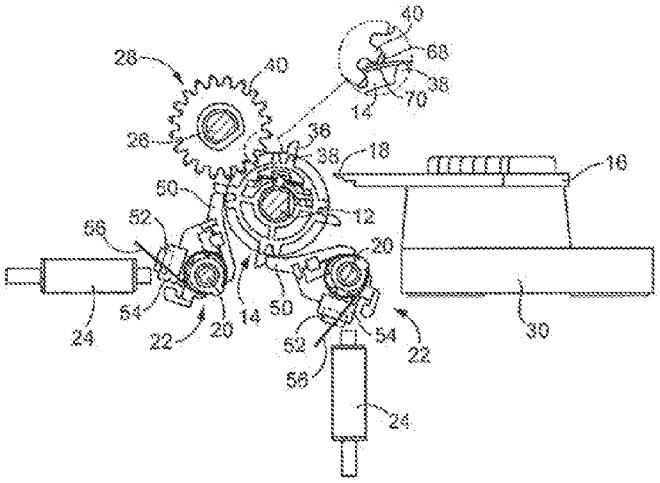
FIG. 2 is a schematic view showing a mechanical performance unit of the music box as viewed from an axial direction of a first shaft according to one or more aspects of the disclosure.
Figure 3:
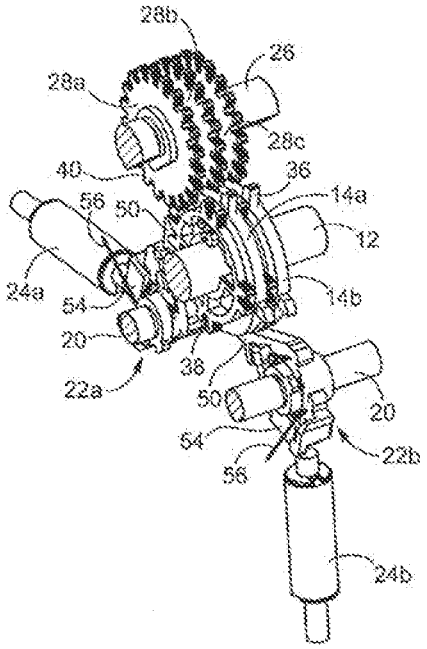
FIG. 3 is a perspective view of the mechanical performance unit shown in FIG. 2 according to one or more aspects of the disclosure.

FIG. 2 is a view of the mechanical performance unit 100 in the music box 10 along the axial direction of the first shaft 12 illustrating the structures of the star wheels 14, the anchoring members 22, the sun wheels 28, and the like. FIG. 3 is a perspective view from an angle obliquely above the mechanical performance unit 100 illustrating the structures of the star wheels 14, the anchoring members 22, the sun wheels 28, and the like. FIG. 3 shows two star wheels 14*a* and 14*b* of the plurality of star wheels 14 and two electromagnets 24*a* and 24*b* for the corresponding engaging members 22*a* and 22*b*.

In all drawings other than FIG. 3, where it is not necessary to distinguish among individual star wheels 14*a* and 14*b*, each star wheel is simply referred to using the reference numeral 14. Similarly, engaging members are simply referred to using the reference numeral 22 when it is not necessary to distinguish between individual engaging members 22*a* and 22*b*, and sun wheels are simply referred to using the reference numeral 28 when it is not necessary to distinguish among individual sun wheels 28*a*, 28*b*, and 28*c*.

The example of FIG. 3 shows the sun wheels 28*a* and 28*b* engageable with the star wheels 14*a* and 14*b*, as well as the sun wheel 28*c* neighboring the sun wheel 28*b*. Here, a neighboring sun wheel 28 is defined as a sun wheel 28 positioned next to another sun wheel 28 along the second shaft 26. The frame 30*b* has omitted from FIG. 2. The vibration plate 16, the bedplate 29, and the frame 30*b* have been omitted from FIG. 3 while portions of the first shaft 12, the third shaft 20, and the second shaft 26 are also omitted (cut).

As shown in FIGS. 2 and 3, each star wheel 14 is provided with a plurality of protruding parts 36 that protrude radially outward from the peripheral edge thereof. Preferably, four of the protruding parts 36 are provided at equal intervals, i.e., at every 90 degrees, around the periphery of the star wheel 14 in the circumferential direction thereof. A plurality of gear teeth 38 are formed at a position radially inside of the protruding parts 36. Preferably two of the gear teeth 38 are provided at positions corresponding to each protruding part 36. The gear teeth 38 are arranged between the star wheel 14 and the adjacent star wheel 14 in the first shaft 12 and, hence, are disposed at different positions from the protruding parts 36 with respect to the axial direction of the first shaft 12. In other words, the gear teeth 38 are positioned between pairs of neighboring protruding parts 36 with respect to the axial direction of the first shaft 12.

Each sun wheel 28 is provided with a plurality of gear teeth 40 around its peripheral edge. When the star wheel 14 is assembled on the first shaft 12 as shown in FIG. 2, the protruding parts 36 are disposed at positions for contacting at least a portion of the vibration valve 18 aligned with the rotational path of the protruding parts 36 upon the rotation of the star wheel 14 about the first shaft 12, i.e., the locus of the protruding part 36 is overlapped with the vibration valve 18. Further, the positions of the protruding parts 36 are disposed at positions such that the anchoring member 22 can engage the protruding parts 36 in an anchoring state described later. That is, when the anchoring member 22 contacts one of the protruding parts 36, the star wheel 14 is prevented from following the rotation of the first shaft 12. By contacting the protruding part 36 after the protruding part 36 has plucked the corresponding vibration valve 18 on the vibration plate 16, the anchoring member 22 functions as a stopper for preventing the star wheel 14 from continuing to follow the rotation of the first shaft 12. The rotational path of the gear teeth 38 about the axial center of the first shaft 12 is aligned with the corresponding gear teeth 40 of the sun wheel 28 so that the gear teeth 38 can engage with the gear teeth 40 provided on the sun wheel 28.

As illustrated in the enlarged view of FIG. 2 (the portion encircled by a dashed line), the gear teeth 40 of the sun wheel 28 is formed with chamfered edges 68 at the distal ends of the gear teeth 40 and preferably on both sides in the axial direction of the sun wheel 28. Chamfered edges 70 (see FIG. 4) are formed on the outer circumferential edges of the star wheels 14. The star wheel 68 defines an outer circumferential surface 72 formed with the chamfered edges 70. The star wheel 14 has two outer edges in the axial direction on the outer circumferential surface 72. The star wheels 14 are respectively interposed between pairs of neighboring sun wheels 28 in the axial direction of the second shaft 26. Thus, the gear teeth 40 provided on each sun wheel 28 protrude radially inside the circumferential surfaces 72 of the star wheels 14, whereby the star wheels 14 are fixed in position relative to the axial direction of the first shaft 12.

At least one of the chamfered edges 68 on the sun wheel 28 and the chamfered edges 70 on the star wheel 14 may be formed. In addition to the chamfered edges 70 formed in the circumferential surface 72 of the star wheel 14, chamfered edges may be formed in the edges of the protruding parts 36 (both axial edges) and the like.

Figure 4:
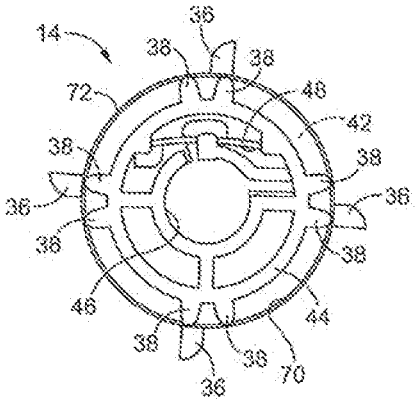
FIG. 4 is a front view of a star wheel provided in the music box as viewed from an axial direction thereof according to one or more aspects of the disclosure.

FIG. 4 is a front view of the star wheel 14 taken along the axial direction thereof to illustrate the structure of the star wheel 14 in greater detail. As shown in FIG. 4, the star wheel 14 preferably has a metal plate part 42 provided with the plurality of protruding parts 36 protruding radially outward therefrom. The metal plate part 42 is provided in a synthetic resin part 44 formed of an engineering plastic or other synthetic resin material through a process called insert molding. Insert molding is a method of integrally molding a metal member and a synthetic resin member by injecting the synthetic resin material around the metal member that has been pre-inserted within a metal die (the same method is used for other cases of insert molding described below). The synthetic resin part 44 preferably covers all portions of the metal plate part 42, excluding the protruding parts 36. The gear teeth 38 are resinous gear parts that are preferably configured as part of the synthetic resin part 44. As a result, the positional relationships of the protruding parts 36 and the gear teeth 38 can be maintained, even when a strong external force is applied to the protruding parts 36.

The synthetic resin part 44 has a center region formed with an assembly hole 46 penetrating the star wheel 14 in the axial direction thereof. The synthetic resin part 44 is assembled on the first shaft 12 by inserting the first shaft 12 through the assembly hole 46. The assembly hole 46 is formed at the center region of the synthetic resin part 44, thereby reducing the occurrence of chattering when the star wheel 14 contacts the corresponding sun wheel 28. The star wheel 14 is configured so that when assembled on the first shaft 12, a prescribed frictional force is exerted between the inner peripheral surface of the assembly hole 46 and the outer peripheral surface of the first shaft 12. Specifically, as shown in FIG. 4, the star wheel 14 is preferably provided with a friction spring 48 for producing a frictional force between the inner peripheral surface of the assembly hole 46 and the outer peripheral surface of the first shaft 12. The friction spring 48 is preferably piano wire that is deformed such that its restoring force pushes the inner peripheral surface of the assembly hole 46 against the outer peripheral surface of the first shaft 12. The frictional force produced by the friction spring 48 is stronger than the force acting to rotate the star wheel 14 and weaker than the force for disengaging the star wheel 14 from the anchoring member 22. With this configuration, the star wheel 14 is mounted on the first shaft 12 and can rotate about the same.

When the anchoring member 22 is in a non-anchoring state described later, the frictional force generated at the area of contact between the star wheel 14 and the first shaft 12 causes the star wheel 14 to rotate along with the first shaft 12. If the frictional force generated by the friction spring 48 is weaker than the force for rotating the star wheel 14, there is a danger that the star wheel 14 will spin out (i.e., slide over rather than rotate together with the first shaft 12) while the star wheel 14 is disengaged from the anchoring member 22. Conversely, if the frictional force is stronger than the force required to extract the star wheel 14 from the anchoring member 22 while the anchoring member 22 is in the anchored state, there is a danger that the star wheel 14 will force a plate member 50 (described later) of the anchoring member 22 to move leftward in FIG. 5 and inadvertently disengage from the anchoring member 22.

Figure 5:
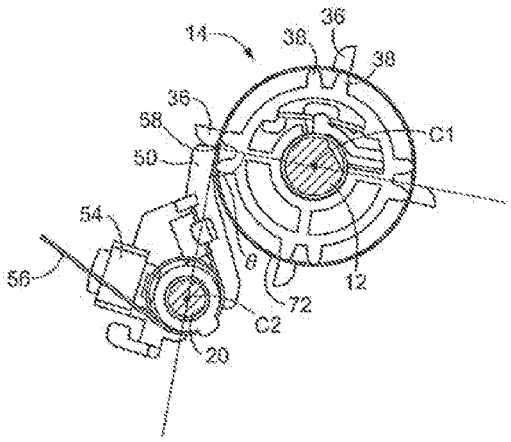
FIG. 5 is a schematic view illustrating a positional relationship between the star wheel and an anchoring member when the anchoring member is in an anchoring state according to one or more aspects of the disclosure.

As shown in FIGS. 2 and 5, the anchoring member 22 includes a plate member 50, a magnetic member 52, a synthetic resin member 54, a torsion coil spring 56, and a concave part 74. The plate member 50 is adapted to contact the protruding part 36 on the corresponding star wheel 14 by rotating the anchoring member 22 toward the star wheel 14 about the third shaft 20. The magnetic member 52 reacts to the magnetic force of the electromagnet 24 so as to rotate the anchoring member 22 in a direction for separating the anchoring member 22 from the star wheel 14. The magnetic member 52 is formed of metal whose primary component is an iron group element, such as iron, cobalt, or nickel. The magnetic member 52 is preferably an iron sheet that is not necessarily magnetized, but may be a permanent magnet (which is magnetized). The magnetic member 52 is formed in the synthetic resin member 54 through insert molding. In other words, the magnetic member 52 is embedded in the synthetic resin member 54. The synthetic resin member 54 is formed of an engineering plastic or the like provided integrally with the plate member 50. This construction can reduce chattering in the magnetic member 52 caused by the attraction of the electromagnet 24. The torsion coil spring 56 urges the anchoring member 22 to rotate toward the star wheel 14.

The electromagnet 24 is preferably configured of a cylindrical coil disposed around an iron core or other magnetic material. When electricity is supplied to the coil, the electromagnet 24 enters an excitation state in which a magnetic force (magnetic field) is produced. When electricity is not flowing through the coil, the electromagnet 24 remains in a non-excitation state. In other words, the electromagnet 24 is a common electromagnet known in the art.

Figure 11:
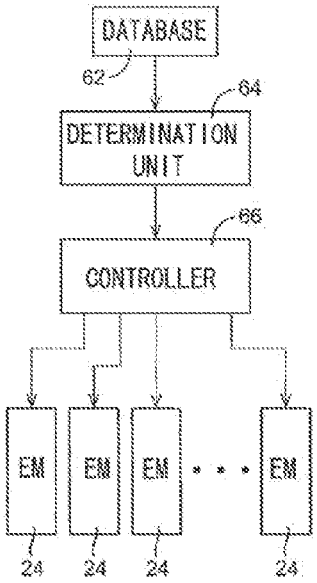

Next, the engaging and disengaging operations of the anchoring member 22 will be described with reference to FIG. 11. FIG. 11 is a block diagram showing the primary control functions possessed by the ECU 60. As shown in FIG. 11, the ECU 60 includes a musical score database 62, a release timing determination unit 64, and an electromagnet excitation control unit 66.

The musical score database 62 stores data for a plurality of musical scores corresponding to songs or melodies for the music box 10 to play. The musical score database 62 is stored on a storage medium, such as an SD card (Secure Digital card) well known in the art, and the ECU 60 is capable of reading the data stored on the storage medium. The musical scores may be stored in a data format such as MIDI (Musical Instrument Digital Interface) and may include a plurality of tracks (channels) for a predetermined plurality of instrument types, wherein the output timing, tone, and the like for sounds is specified for each instrument. As is described below in greater detail, the music box 10 according to the preferred embodiment can control a musical performance based on output timings, musical tones, and the like of each track corresponding to the melodic theme of the MIDI data, for example.

The release timing determination unit 64 determines a release timing at which each of the anchoring members 22 releases the engagement with the protruding part 36 of the corresponding star wheel 14. In other words, the release timing determination unit 64 determines the release timing for switching the excitation/non-excitation state of the electromagnet 24 corresponding to each of the anchoring members 22 (the release timing at which electricity to the electromagnets 24 is conducted and halted). For example, while the mechanical performance unit 100 is performing a melody corresponding to prescribed data for one of the musical scores stored in the musical score database 62, the release timing determination unit 64 performs the above determinations based on the output timing and musical tone for each sound specified in the musical score data. More specifically, the release timing determination unit 64 determines the release timing at which each anchoring member 22 releases the protruding part 36 of the corresponding star wheel 14 in order that the vibration valves 18 corresponding to the various musical tones are plucked at the output timings set in the musical score data.

When the rotations of the first shaft 12 and the second shaft 26 are set to constant speeds, a time lag indicating a period of time from when the anchoring member 22 releases the protruding part 36 of the corresponding star wheel 14 to when the protruding part 36 plucks the corresponding vibration valve 18 is determined in advance. The release timing determination unit 64 determines the release timing based on the musical score data for the melody being played. The output timing for the musical tone corresponding to each vibration valve 18 is specified in the musical score data. Thus, the release timing determination unit 64 determines the release timing such that the anchoring member 22 corresponding to the vibration valve 18 releases the protruding part 36 of the corresponding star wheel 14 prior to the output timing by a length of time equivalent to the time lag. In other words, after switching the electromagnet 24 from a non-excitation state to an excitation state, the release timing determination unit 64 makes a determination to switch the electromagnet 24 back to a non-excitation state after a predetermined time has elapsed.

The electromagnet excitation control unit 66 switches the state of each electromagnet 24 between the excitation state and the non-excitation state based on the determination results of the release timing determination unit 64. In other words, the electromagnet excitation control unit 66 controls the timing at which electricity is conducted to, and not conducted to, each of the electromagnets 24 based on the determination results of the release timing determination unit 64. For example, when the release timing determination unit 64 has determined the release timing at which the anchoring member 22 releases the protruding part 36 of the corresponding star wheel 14, the electromagnet excitation control unit 66 switches the state of the corresponding electromagnet 24 from the non-excitation state to the excitation state based on this timing. Hence, the electromagnet excitation control unit 66 begins conducting electricity to the electromagnet 24 at this timing. After switching the electromagnet 24 from the non-excitation state to the excitation state, the electromagnet excitation control unit 66 preferably switches the electromagnet 24 back to the non-excitation state after a predetermined time has elapsed. Hence, the electromagnet excitation control unit 66 halts the conduction of electricity at this timing.

Figure 6:
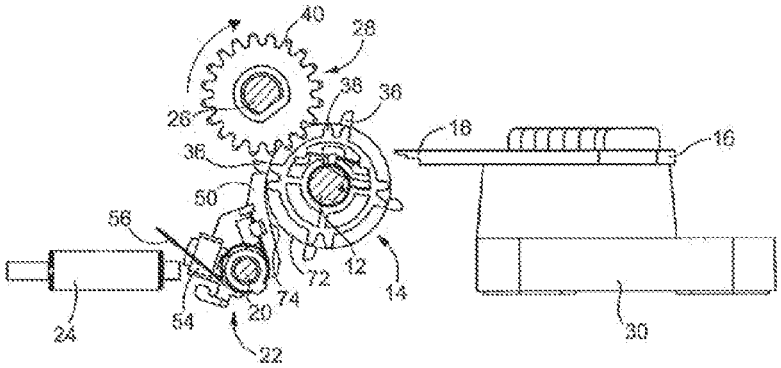
FIG. 6 is a schematic view of the mechanical performance unit when the anchoring member is in the anchoring state according to one or more aspects of the disclosure.

As shown in FIG. 2, the electromagnet 24 is provided for each of the anchoring members 22. The electromagnet 24 is positioned near the synthetic resin member 54 of the anchoring member 22 having the embedded magnetic member 52, but is separated from the magnetic member 52 so as not to contact the same. In other words, the anchoring member is closest to the electromagnet 24 in a closest position shown in FIGS. 7 and 8, and then the anchoring member 22 does not contact the electromagnets 24 in the closest position. That is, a prescribed gap is formed between the magnetic member 52 and the electromagnet 24 whether the anchoring member 22 is in an anchoring state or a non-anchoring state described later. This gap should fall within a range in which the magnetic force of the electromagnet 24 can affect the magnetic member 52 when the electromagnet 24 is excited. For example, the gap should be designed such that the magnetic force of the excited electromagnet 24 will attract the magnetic member 52, even when the anchoring member 22 is the farthest from the electromagnet 24 in a far position, as shown in FIG. 6. Moreover, the gap should be set such that the attracting force of the electromagnet 24 can rotate the anchoring member 22 in a direction away from the star wheel 14. As indicated by the chain line in FIG. 8, the axial center of the electromagnet 24 (central axis of the iron core) is configured to intersect the rotational center of the anchoring member 22 (i.e., the axial center of the third shaft 20), as will be described later.

The torsion coil spring 56 preferably urges the anchoring member 22 and the plate member 50 toward the star wheel 14 when the electromagnet 24 is in the non-excitation state. The plate member 50 is an anchoring state (see FIG. 6 described later) for anchoring at the protruding parts 36 provided on the corresponding star wheel 14. However, when the electromagnet 24 is in the excitation state, the magnetic force of the electromagnet 24 causes the anchoring member 22 and the plate member 50 to rotate about the third shaft 20 in a direction away from the star wheel 14 against the urging force of the torsion coil spring 56. The anchoring member 22 comes to a halt at a position in which the force of attraction on the magnetic member 52 corresponding to the magnetic force of the electromagnet 24 is counterbalanced by the urging force of the torsion coil spring 56. In this position, the anchoring member 22 is in the non-anchoring state (see FIGS. 7 through 9 described later) in which the plate member 50 no longer anchors the protruding part 36.

As illustrated in FIGS. 2 and 3, the electromagnets 24 and the anchoring members 22 corresponding to these electromagnets 24 belong to either a first group or a second group. The electromagnets 24 and the anchoring members 22 belonging to the first group are arranged at a 90-degree phase differential about the axial center of the first shaft 12 (at a position for forming an angle of 90 degrees) with the electromagnets 24 and the anchoring members 22 belonging to the second group. If the electromagnets 24 were numbered from 1 to n from one end of the second shafts 20 to the other, the electromagnets 24 with odd numbers preferably belong to the first group while those with even numbers preferably belong to the second group. Thus, the electromagnets 24, such as the electromagnets 24*a* and 24*b* in FIG. 3 corresponding to the pair of adjacent star wheels 14*a* and 14*b*, are preferably arranged apart from each other by a phase of 90 degrees about the axial center of the first shaft 12. This configuration minimizes the space required for arranging the mechanical performance unit 100 (and particularly the electromagnets 24) in the music box 10, thereby reducing the size of the music box 10.

FIG. 5 shows an example of the positional relationship between the anchoring member 22 and the corresponding star wheel 14 when the anchoring member 22 is in the anchoring state. When the anchoring member 22 is in this state, the angle θ formed by a straight line passing through a contact part 58 at which the protruding part 36 contacts the plate member 50 of the anchoring member 22 and a rotational center C1 of the star wheel 14, and a straight line passing through the contact part 58 and a rotational center C2 of the anchoring member 22 is preferably within a prescribed range with respect to a right angle (90 degrees) as a reference angle. This prescribed range is 90±10 degrees, for example. When the angle θ is smaller than this prescribed angular range, the anchoring member 22 can more easily disengage from the protruding part 36 and, hence, cannot as easily anchor the star wheel 14. When the angle θ is greater than the prescribed angular range, a relatively large force is necessary to disengage the anchoring member 22 from the protruding part 36 and, hence, the anchoring member 22 does not disengage easily. However, when the angle θ is within the prescribed angular range, the anchoring member 22 is restrained from disengaging when the electromagnet 24 is in the non-excitation state and can be suitably disengaged when the electromagnet 24 is shifted to the excitation state.

FIGS. 6 through 9 detail the operations of the mechanical performance unit 100 having the structure described above. When the music box 10 is playing a melody, the first shaft 12 and the second shaft 26 are constantly and synchronously driven by the motor 32 to rotate about their axial centers. As indicated by arrows in the drawings, the first shaft 12 and the second shaft 26 are driven to rotate in opposite directions. The first shaft 12 is preferably rotated such that the protruding parts 36 provided on the star wheel 14 move in a direction for plucking the corresponding vibration valves 18 of the corresponding vibration plate 16 upward. The second shaft 26 is rotated so that the star wheels 14 are driven to rotate in the direction indicated by the arrow when the gear teeth 38 of the star wheels 14 are engaged with the gear teeth 40 of the corresponding sun wheels 28. Since the sun wheels 28 are incapable of rotating relative to the second shaft 26, the sun wheels 28 are constantly rotated about their axial centers as the second shaft 26 rotates about its axial center while the music box 10 is playing a melody.

FIG. 6 illustrates the operations of the mechanical performance unit 100 when the anchoring member 22 is in the anchoring state. In the state shown in FIG. 6, electricity is not being supplied to the electromagnet 24 and thus the electromagnet 24 is in a non-excitation state. At this time, the torsion coil spring 56 urges the plate member 50 of the anchoring member 22 so that the anchoring member 22 is rotated toward the star wheel 14 and one of the protruding parts 36 on the corresponding star wheel 14 is anchored by the anchoring member 22. That is, one of the protruding parts 36 contacts the distal end of the plate member 50 on the downstream side with respect to the rotating direction of the first shaft 12 (the side in which the rotation progresses).

As described above, the star wheel 14 is configured to follow the rotation of the first shaft 12 through the frictional force generated at the point of contact with the first shaft 12. In the state shown in FIG. 6, the anchoring member 22 is in the anchoring state for preventing the star wheel 14 from following the rotation of the first shaft 12, despite the frictional force at the contact point therebetween. That is, the star wheel 14 provided on the first shaft 12 rotates relative to the first shaft 12, with the surfaces of contact between the assembly hole 46 of the star wheel 14 and the first shaft 12 sliding over each other with a light load, while the phase of the star wheel 14 (the positional relationship of the star wheel 14 relative to the vibration valve 18 and the like) remains fixed. In this state, the gear teeth 38 on the star wheel 14 are not engaged with the gear teeth 40 on the sun wheel 28 and, hence, the rotation of the sun wheel 28 does not affect the rotation of the star wheel 14.

Figure 7:
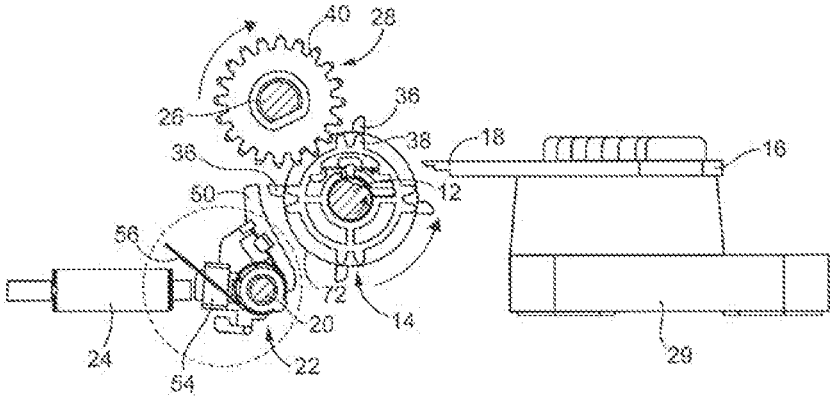
FIG. 7 is a schematic view of the mechanical performance unit when the anchoring member is shifted from the anchoring state to a non-anchoring state according to one or more aspects of the disclosure.

FIG. 7 illustrates the operations of the mechanical performance unit 100 when the anchoring member 22 is switched from the anchoring state to the non-anchoring state. When electricity is conducted to the electromagnet 24 while the mechanical performance unit 100 is in the state shown in FIG. 6, the electromagnet 24 is brought into the excitation state. The magnetic force produced by the electromagnet 24 causes the plate member 50 of the anchoring member 22 to rotate about the third shaft 20 against the urging of the torsion coil spring 56 in a direction away from the star wheel 14. Consequently, the plate member 50 that has anchored the protruding part 36 disengages therefrom, enabling the star wheel 14 to rotate together with the first shaft 12 due to the frictional force generated at the area of contact between the star wheel 14 and the first shaft 12.

Figure 8:
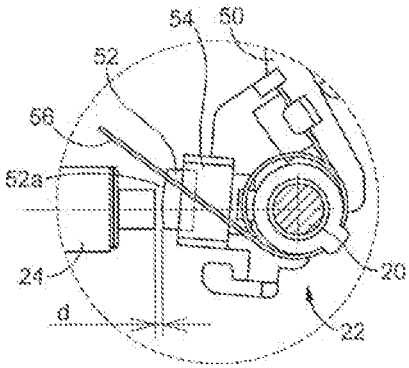
FIG. 8 is a partial enlarged view of an encircled region depicted in dotted line of FIG. 7 according to one or more aspects of the disclosure.

FIG. 8 shows an enlarged view of the area in FIG. 7 encircled by a dashed line. When the anchoring member 22 is in the non-anchoring state shown in FIG. 7, the magnetic member 52 is in the closest position to the axial center of the electromagnet 24 at the distal end thereof. In this state, the electromagnet 24 and the magnetic member 52 are not in contact with each other, and a gap d exists between the two, as shown in FIG. 8. A curved surface 52*a* is preferably formed on the side of the magnetic member 52 nearest the electromagnet 24. The curved surface 52*a* has a columnar shape centered on the third shaft 20. Hence, the gap d between the electromagnet 24 and the magnetic member 52 will not change when the anchoring member 22 is rotated about the third shaft 20.

Figure 9:
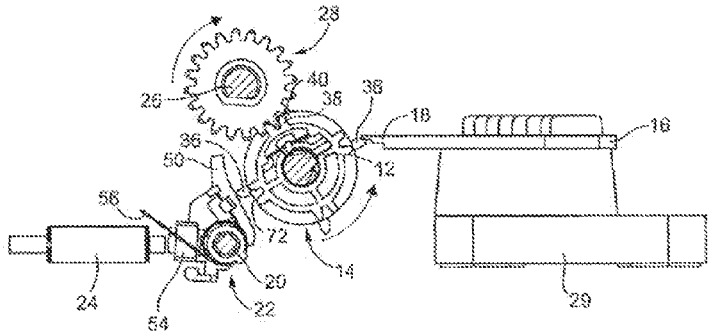
FIG. 9 is a schematic view of the mechanical performance unit when a protruding part of the star wheel plucks a vibration valve of a vibration plate according to one or more aspects of the disclosure.

FIG. 9 illustrates the operations of the mechanical performance unit 100 for playing a sound by plucking the vibration valve 18 of the vibration plate 16 with the corresponding protruding part 36 on the star wheel 14. In this operation, the electromagnet 24 is rendered in the non-anchoring state, causing the plate member 50 to disengage from the protruding part 36. Subsequently, the star wheel 14 begins to follow the rotation of the first shaft 12 due to the frictional force generated at the area of contact between the first shaft 12 and the star wheel 14. When the star wheel 14 is near a phase in which one of the protruding parts 36 contacts the corresponding vibration valve 18 on the vibration plate 16, the corresponding gear teeth 38 adjacent to the protruding part 36 in the rotating direction (at a phase difference of 90 degrees in the rotating direction) are engaged with the gear teeth 40 on the sun wheel 28. In this state, the rotation of the sun wheel 28 drives the star wheel 14 in the direction of the arrow indicated in FIG. 9, i.e., in a direction for moving the protruding part 36 upward to pluck the vibration valve 18 on the vibration plate 16. Through this operation, a sound at the tone corresponding to the vibration valve 18 is played.

The frame-moving device 80 (example of a moving mechanism) is adapted to move the frame 30*b* relative to the enclosure 34 along the extended direction of the vibration valves 18 on the vibration plate 16 in order to adjust the distance between the vibration valves 18 and the corresponding star wheels 14. In the music box 10 of the preferred embodiment, the bedplate 29 for mounting the vibration plate 16 is fixed on the lower frame 31. The vibration plate 16 is fixed in position relative to the lower frame 31. Hence, the frame 30*b* for rotatably supporting the first shaft 12 and the second shaft 26 can be moved by the frame-moving device 80 relative to the enclosure 34 in the extended direction of the vibration valves 18.

Figure 12:
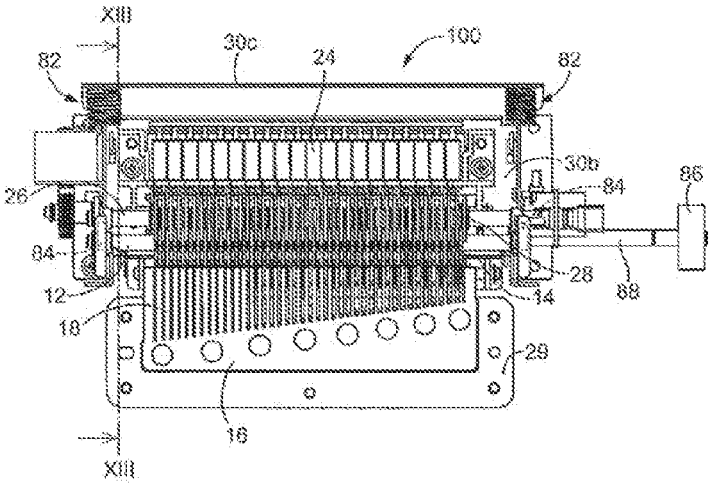
FIG. 12 is a plane view of the mechanical performance unit according to one or more aspects of the disclosure.
Figure 13:
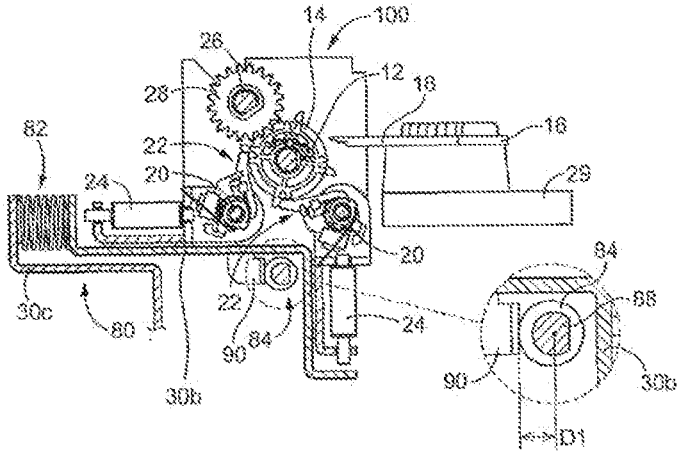
FIG. 13 is a cross-sectional view of the mechanical performance unit and a frame-moving device taken along a line XIII-XIII shown in FIG. 12 according to one or more aspects of the disclosure.

FIG. 12 is a plan view of the mechanical performance unit 100 illustrating the detailed structure of the frame-moving device 80. FIG. 13 is a cross-sectional view taken along XIII-XIII in FIG. 12. As shown in FIGS. 12 and 13, the frame-moving device 80 is provided with a plurality of spring 82, a plurality of cam mechanisms 84, an adjustment knob 86, and an adjustment shaft 88. The springs 82 and the cam mechanisms 84 are provided at corresponding positions in the axis of the adjustment shaft 88, i.e., in the axial direction of the first shaft 12. In other words, a set including one each of the springs 82 and the cam mechanisms 84 is disposed at each position relative to the axial direction of the adjustment shaft 88. In the example of FIG. 12, one each of the springs 82 and the cam mechanisms 84 is provided on each axial end of the first shaft 12. The spring 82 serves as an urging member.

As shown in FIG. 13, the spring 82 is interposed between the frame 30*b* and the frame 30*c*. The spring 82 urges the frame 30*b* in a direction toward the vibration plate 16 and relative to the lower frame 31 (i.e., the enclosure 34). As shown in FIG. 10, the frame 30*b* can slidingly move along the extended direction of the vibration valves 18 relative to the frame 30*c*.

The cam mechanism 84 functions to push the frame 30*b* in a direction away from the vibration plate 16 and relative to the lower frame 31 against the urging force of the spring 82. As shown in FIG. 12, the adjustment knob 86 integrally rotates with the adjustment shaft 88 about the same axial center. The cam mechanism 84 is mounted on the adjustment shaft 88 so as to rotate integrally with the same. The adjustment shaft 88 is arranged parallel to the first shaft 12 and is rotatably supported on the lower frame 31. When the adjustment knob 86 is turned, the adjustment shaft 88 rotates about the axial center thereof, and the cam mechanism 84 rotates together with the adjustment shaft 88.

Figure 14:
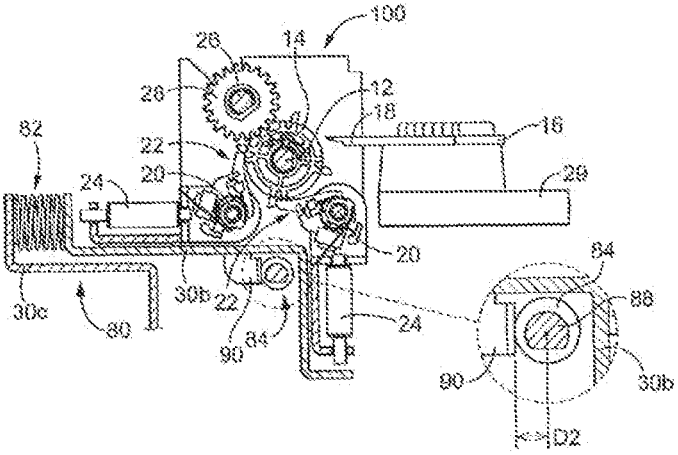
FIG. 14 is a schematic view of the mechanical performance unit and the frame-moving device when a cam mechanism is rotated by 90 degree from a state shown in FIG. 13 according to one or more aspects of the disclosure.
Figure 15:
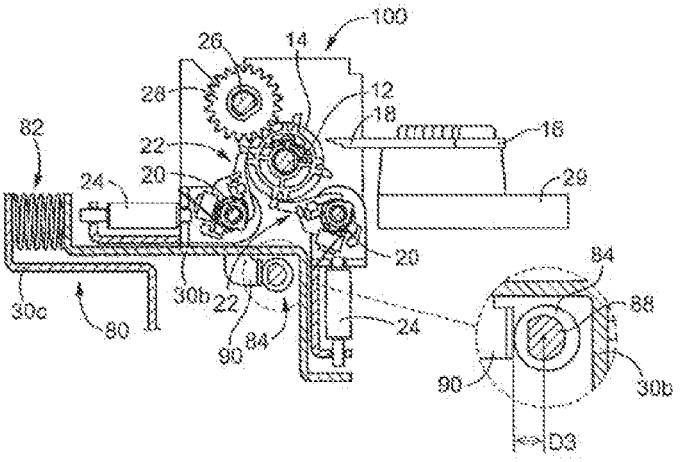
FIG. 15 is a schematic view of the mechanical performance unit and the frame-moving device when the cam mechanism is rotated by 180 degree from the state shown in FIG. 13 according to one or more aspects of the disclosure.

FIGS. 13 through 15 illustrate how the frame-moving device 80 moves the frame 30*b* along the extended direction of the vibration valves 18 relative to the lower frame 31 (enclosure 34). Each of FIGS. 13 through 15 includes an enlarged view of a region near the cam mechanism 84 (the region encircled by a dashed line in the drawings). FIG. 13 shows the state of the mechanical performance unit 100 when the volume is set to a low level; FIG. 14 shows the state when the volume is set to a medium level; and FIG. 15 shows the state when the volume is set to a high level.

The earn mechanism 84 is a well-known mechanism having a circumferential surface that is not uniform in distance from the rotational axis thereof. The circumferential surface effects movement in other members as the cam mechanism rotates.

More specifically, contact parts 90 are integrally provided on the frame 30*b*. The contact parts 90 confront the corresponding cam mechanisms 84 in the extended direction of the vibration valves 18. The distance between the contact parts 90 and the axial center of the adjustment shaft 88 is D1 in the state shown in FIG. 13. When the adjustment shaft 88 is rotated 90° clockwise from the state shown in FIG. 13 to the state shown in FIG. 14, the distance between the contact parts 90 and axial center of the adjustment shaft 88 changes to D2 (where D2<D1). At this time, the urging force of the springs 82 pushes the frame 30*b* relative to the enclosure 34 by a distance equivalent to the difference between the distances D1 and D2 (D1-D2). Hence, the frame 30*b* moves toward the vibration valves 18 in the extended direction of the same by the distance D1-D2.

When the adjustment shaft 88 is further rotated 90° clockwise from the state shown in FIG. 14 to the state shown in FIG. 15, the distance between the contact parts 90 and axial center of the adjustment shaft 88 changes to a distance D3 (where D3<D2). At this time, the urging force of the springs 82 pushes the frame 30*b* relative to the enclosure 34 by a distance equal to the difference between distances D2 and D3 (D2-D3). Hence, the frame 30*b* moves toward the vibration valve 18 along the extended direction thereof by the distance D2-D3.

As described above, the vibration plate 16 is fixed to the lower frame 31 (enclosure 34). Accordingly, the vibration valves 18 are fixed in position relative to the lower frame 31. When the frame-moving device 80 moves the frame 30*b* relative to the lower frame 31 along the extended direction of the vibration valves 18, the distance varies between the vibration valves 18 and the corresponding star wheels 14, and more particularly between the vibration valves 18 and the protruding parts 36 on the corresponding star wheels 14.

Figure 16:
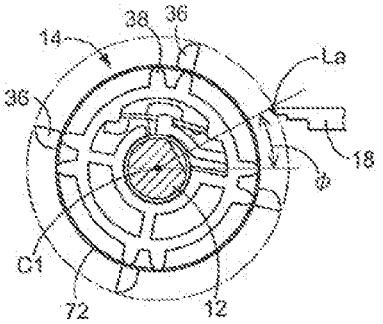
FIG. 16 is a schematic view showing an overlap amount of a protruding part relative to a vibration valve according to one or more aspects of the disclosure.

This change in distance modifies an overlap amount La by which the protruding parts 36 overlap the corresponding vibration valves 18, as shown in FIG. 16. The overlap amount La is equivalent in size to the portion of the vibration valves 18 that fall within the rotational path of the outer radial ends of the protruding parts 36 (indicated by a chain line in FIG. 16). That is, the overlap amount La is an amount by which the rotational locus of the protruding parts 36 (indicated by a chain line in FIG. 16) is overlapped with the corresponding vibration valve 18. By varying the overlap amount La of the protruding parts 36 relative to the vibration valves 18, it is possible to vary the volume produced when the protruding parts 36 pluck the corresponding vibration valves 18. More specifically, the larger the overlap amount La, the greater the volume.

In other words, as the protruding parts 36 moves close to the vibration valves 18, the volume of sound produced is increased when the vibration valves 18 are plucked. In the music box 10 according to the preferred embodiment, the range in movement of the frame 30*b* relative to the lower frame 31, i.e., the distance over which the frame 30*b* can be moved in the extended direction of the vibration valves 18 is preferably between 0.1 and 1.0 mm.

As shown in FIG. 16, an angle $\phi$ is formed by a horizontal line passing through the rotational center C1 of the first shaft 12 (a line parallel to the inner bottom surface 34*a*) and a straight line passing the rotational center C1 of the first shaft 12 and a contact part of the vibration valve 18 that the protruding part 36 contacts. This angle $\phi$ is preferably within the range 45°±10°. If the angle $\phi$ were set smaller than this range, the volume changes would be greater in response to changes in the overlap amount La, making suitable adjustments difficult. On the other hand, if the angle $\phi$ were greater than this range, the volume changes would be smaller in response to changes in the overlap amount La, making adjustments in volume nearly indiscernible.

The music box 10 may be provided with a cam mechanism having a different structure from the cam mechanism 84 shown in the example of FIGS. 13 through 15. For example, the cam mechanism may have a polygonal (hexagonal, for example) shape whose sides are positioned at different distances from the axial center of the adjustment shaft 88 when viewed in the axial direction. Alternatively, the cam mechanism may have an oval shape when viewed in the axial direction. With the cam mechanism 84 shown in FIGS. 13 through 15, the distance between the vibration valves 18 and the corresponding star wheels 14 can be changed continuously, but the music box 10 may be provided with a cam mechanism for changing this distance in a stepwise manner. A cam mechanism for changing the distance between the vibration valves 18 and corresponding star wheels 14 in two steps may be used for varying the sound volume of the music box between low and high settings.

The music box 10 described above has the springs 82 for urging the frame 30*b* relative to the lower frame 31 (enclosure 34) toward the vibration plate 16, and the cam mechanisms 84 for pushing the frame 30*b* away from the vibration plate 16 relative to the lower frame 31 against the urging force of the springs 82, but the springs 82 and the cam mechanisms 84 may be configured differently. For example, the springs 82 may urge the frame 30*b* in a direction away from the vibration plate 16, while the cam mechanisms 84 push the frame 30*b* toward the vibration plate 16 against the urging force of the spring 82.

The magnetic member of the anchoring member 22 may be configured of a permanent magnet. When the electromagnet 24 is in the excitation state, the magnetic force of the electromagnet 24 causes the permanent magnet to rotate the anchoring member 22 in the first rotating direction. The permanent magnet is preferably formed in the synthetic resin member 54, which is integrally provided with the plate member 50, through insert molding, and is preferably positioned to produce a repelling force (force of repulsion between like magnetic poles) with the electromagnet 24 when the electromagnet 24 is excited.

The magnetic force of the electromagnet 24, i.e., the force of repulsion produced between the electromagnet 24 and the permanent magnet, moves the plate member 50 of the anchoring member 22 against the urging force of the torsion coil spring 56. Accordingly, the anchoring member 22 rotates about the third shaft 20 in a direction away from the star wheel 14 (the first rotating direction), thereby disengaging the plate member 50 from the protruding part 36 and placing the anchoring member 22 in the non-anchoring state.

While the disclosure has been described in detail with reference to specific embodiments thereof, it would be apparent to those skilled in the art that many modifications and variations may be made therein without departing from the spirit of the disclosure, the scope of which is defined by the attached claims.

In short, the present disclosure is not limited to the structure described above with reference to FIGS. 1 through 14. For example, the number of protruding parts 36 provided on each star wheel 14 is not limited to four and need not be arranged at 90-degree intervals around the periphery thereof. Further, the gear teeth 38 need not be provided at positions corresponding to the protruding parts 36 and may be positioned at different phases around the periphery of the star wheel 14.

Further, the electromagnets 24 and the anchoring members 22 belonging to the first group and the electromagnets 24 and the anchoring members 22 belonging to the second group need not be disposed at 90-degree intervals in a circumferential direction around the axial center of the first shaft 12. For example, all electromagnets 24 may be juxtaposed along the same plane. Conversely, if five or more of the protruding parts 36 were provided around the periphery of the star wheel 14, for example, pluralities of the electromagnets 24 and anchoring members 22 could be arranged at positions corresponding to three or more phases spaced at prescribed phase differences in a circumferential direction around the axial center of the first shaft 12, depending on the number of protruding parts 36 provided. Further, two or more of the anchoring members 22 may be provided for each star wheel 14 as the mechanism for anchoring the star wheel 14.

The ECU 60 may also be connected to the Internet or another communication link and may be configured to download musical score data via the communication link and store this data in the musical score database 62.

In addition, the shape of the star wheel 14, structure of the anchoring member 22 (shape of the plate member 50), phase positions of the various components, and the like may be modified as needed to suit the design of the music box. For example, the gear teeth 38 need not be provided in pairs, but may be provided in groups of one or three or more, provided that the sun wheel 28 can drive the star wheel 14 a sufficient distance and time interval for allowing the protruding part 36 to pluck the corresponding vibration valve 18 of the vibration plate 16,

What is claimed is:

1. A music box comprising:

a plurality of star wheels, each of the plurality of star wheels being configured to rotate about a first axis;

a frame configured to rotatably support the first axis;

a casing;

a vibration plate comprising a plurality of vibration valves corresponding to the plurality of star wheels, each of the plurality of vibration valves extending from the vibration plate in a first direction, the plurality of vibration valves being arrayed along the first axis, the vibration plate being fixed to the casing;

a moving mechanism configured to move the frame so as to separate from the vibration plate in the first direction or approach the vibration plate in a second direction opposite to the first direction.

2. The music box according to claim 1, wherein the moving mechanism comprises:

an urging member configured to urge the frame toward the vibration plate in the second direction; and a cam mechanism configured to move the frame away from the vibration plate in the first direction against an urging force of the urging member.

3. The music box according to claim 1, wherein the moving mechanism comprises:

a plurality of urging members, each of the plurality of urging members being configured to urge the frame toward the vibration plate in the second direction, the plurality of urging members being arrayed along the first axis; and a plurality of cam mechanisms corresponding to the plurality of urging members, each of the plurality of cam mechanisms being configured to move the frame away from the vibration plate in the first direction against an urging force of the plurality of the urging members, the plurality of cam mechanisms being arrayed along the first axis.

4. The music box according to claim 1, wherein the moving mechanism comprises:

a first urging member configured to urge the frame toward the vibration plate in the second direction, the first urging member being disposed at one end portion of the first axis;

a second urging member configured to urge the frame toward the vibration plate in the second direction, the second urging member being disposed at other end portion of the first axis;

a first cam mechanism corresponding to the first urging member, the first cam mechanism being configured move the frame away from the vibration plate in the first direction against an urging force of the first urging member, the first cam mechanism being disposed at the one end portion of the first axis;

a second cam mechanism corresponding to the second urging member, the second cam mechanism being configured move the frame away from the vibration plate the first direction against an urging force of the second urging member, the second cam mechanism being disposed at the other end portion of the first axis.

5. The music box according to claim 1, further comprising a plurality of sun wheels corresponding to the plurality of the star wheels, the plurality of sun wheels being arranged along the first axis, the plurality of sun wheels being fixed on a second axis parallel to the first axis, wherein each star wheel is respectively interposed between one of the plurality of sun wheels and another of the plurality of sun wheels neighboring to the one of the plurality of sun wheels so as to be fixed at a position along the first axis.

6. The music box according to claim 1, wherein the moving mechanism is configured to move the frame to the vibration plate from a first position to a second position in the second direction, wherein the second position is closer to the vibration plate than the first position, wherein each of the plurality of star wheels comprises a protruding part extending outward in a radial direction of the star wheel, the protruding part being configured to rotate along with the star wheel and contact the vibration valves at the first position and the second position.

* * * * *